US006359995B1

(12) United States Patent
Ou

(10) Patent No.: US 6,359,995 B1
(45) Date of Patent: Mar. 19, 2002

(54) EARPHONE FITTABLE TO BOTH EARS BY HANGING

(76) Inventor: Jack Ou, 3FL., No. 12, Lane 47, Fu-Kang St., Nan-Kang District, Taipei City (TW)

( * ) Notice: Subject to any disclaimer, the term of this patent is extended or adjusted under 35 U.S.C. 154(b) by 0 days.

(21) Appl. No.: 09/837,261

(22) Filed: Apr. 19, 2001

(51) Int. Cl.[7] ..... H04R 25/00
(52) U.S. Cl. ..... 381/381; 381/330; 381/380
(58) Field of Search ..... 381/309, 322, 381/323, 327, 328, 330, 370, 374, 380, 381, FOR 149, FOR 150; 181/129, 130, 135; 379/430

(56) References Cited

U.S. PATENT DOCUMENTS 4,453,050 A * 6/1984 Enokido ..... 381/381
5,450,496 A * 9/1995 Burris et al. ..... 381/381

* cited by examiner

*Primary Examiner*—Huyen Le
(74) *Attorney, Agent, or Firm*—Rosenberg, Klein & Lee

(57) ABSTRACT

An earphone fittable to both ears by hanging comprises a housing of a front main body with a vacancy spacing therein forming a battery compartment, a projected male connection port, a push button for ON/Off the power supply, a pilot lamp, an earphone pug. The rear part comprises a bayonet shank, a flexible earphone hanger, and a recessed female connection port. After setting a Lithium battery in the compartment, the two connection ports are coupled with each other by pushing the bayonet shank. The earphone is fittable from one ear to the other by pulling away the bayonet shank to separate the two connection ports, and overturing the bayonet shank 180° about its own longitudinal axis.

4 Claims, 4 Drawing Sheets

EARPHONE FITTABLE TO BOTH EARS BY HANGING

BACKGROUND OF THE INVENTION

1. Field of the Invention

The present invention relates to an earphone fittable to both ears by hanging, and more particularly, to an earphone for a cellular phone fittable to hanging on the user's both ears by overturning the earphone from one side to the other.

2. Description of the Prior Art

It has just been prohibited by the local law using a non handfree cellular phone while driving a vehicle so as to reduce traffic accidents. To meet this requirement, a series of related products appear on the market, among those the most well known one is a handfree kit which gets its power supply from the car lighter. However, frequent insertion of cord plug of the cellular phone may result in early damage to the car lighter, moreover, a handfree kit often occupies part of spacing near the dash board and becomes an obstacle to operation of the gearshift lever and the hand brake. Besides, in case it is necessary to adjust the position of the kit for receiving better incoming signals a momentary meglect of the driver's eyes from the roadway condition might cause a catastrophic traffic accidents!

In the meanwhile, the incoming phone voice is delivered out of an amplifier in the handfree kit, the privacy can not be well protected if there is a third person in the vehicle. On the other hand, using an earphone is surely able to protect communication privacy, but to have an earphone cord meandering nearby the use's body is certainly annoying.

In addition, consistently hearing a calling voice with single ear is tiresome.

Therefore, an invention devoting to resolving aforesaid disadvantages of currently developed cellular phone handfree kits for using in vehicles is definitely necessary, this has been carried out by the present inventor through a long time efforts with an innovative earphone fittable to both ears by hanging.

SUMMARY OF THE INVENTION

It is an object of the present invention to provide an earphone fittable to both ears by hanging which is applicable incorporated with a cellular phone handfree kit in a vehical to meet the current requirement.

It is another object of the present invention to provide an earphone fittable to both ears of the user by simply overturing the earphone from one side to the other so that the user may make a phone call comfortably using his/her both ears alternatively from time to time.

For achieving these and other objects the earpone of the present invention comprises a housing of a front main body with a vacancy spacing therein forming a battery compartment, a projected male connection port, a push button to ON/OFF the power supply, a pilot lamp, an earphone plug. The rear part comprises a bayonet shank, a flexible earphone hanger, and a recessed female connection port. After setting a Lithium battery in the compartment, the male and female connection ports are coupled with each other by pushing the bayonet shank thereby completing the earphone assembly of the present invention. The earphone is fittable from one ear to the other ear by pulling away the bayonet shank to separate the two connection ports, and overturning the bayonet shank about ist own longitudinal axis for 180°, and then coupling again the two connection ports.

To enable a further understanding of the innovative and technological content of the invention herein, refer to the detailed description of the invention and the accompanying brief description of the drawings appended below. Furthermore, the attached drawings are provided for purposes of reference and explanation, and shall not be construed as limitations applicable to the invention herein.

DETAILED DESCRIPTION OF THE PREFERRED EMBODIMENT

Figure 1:
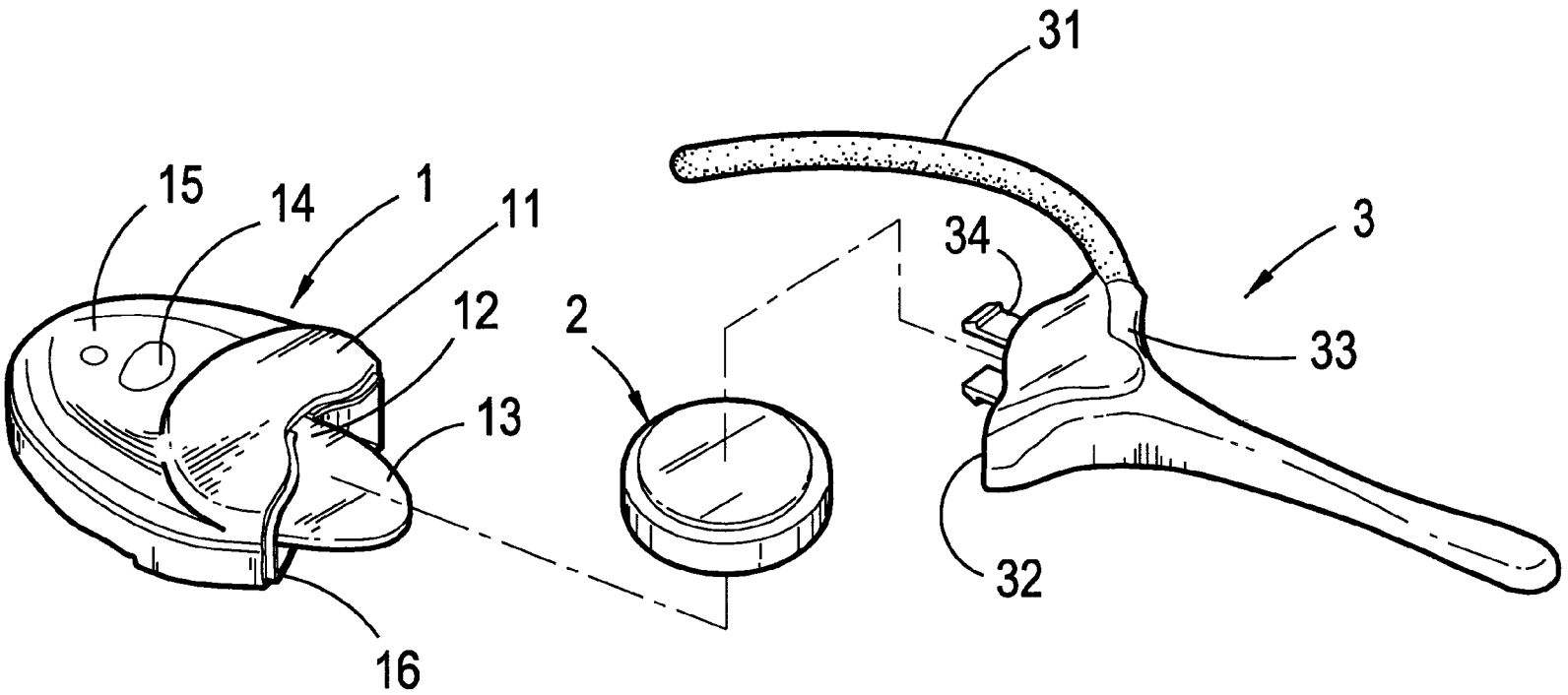
FIG. 1 is an exploded view of the earphone of the present invention.

Referring to FIG. 1, it shows an exploded view of the earphone according to the present invention. The earphone comprises a housing 1 of a front main body 1 with a vacancy spacing 12 therein forming a battery compartment for a lithium battery 2 or the like; a projected male connection port 13; a push button 14 provided on the housing 11 to power supply for the earphone from the battery 2, a pilot lamp 15 for indicating the battery condition by color variation; the above mentioned components contained in the front body 1 is to be coupled with the rear part of the earphone with an engaging rim 16.

The rear part of the earphone is composed of a bayonet shank 3 having a flexible ear hanger 31 attached to its front portion 33 thereof; two tenons 34; and a recessed female connection port 32. The curvature and shape of the ear hanger 31 is adjustable so as to well-fit for various types of ears. Two tenons 34 respectively formed at the upper and the lower portions of the rear insertion part are each equipped with a claw tip so as to firmly grip onto the front main body 1 therewith when the male and the female connection ports 13 and 32 are coupled together by insertion of the bayonet shank 3 thereby completing the earphone assembly. By so the battery 2 is fixedly settled in the battery compartment without loosing its electrical contact. The earphone is fittable from one ear to the other ear by pulling away the bayonet shank 3 to separate the two connection ports 13 and 32, and overturing the bayonet shank 3 about its own longitudinal axis 180°, and then coupling again the two connection ports 13 and 32.

Figure 2:
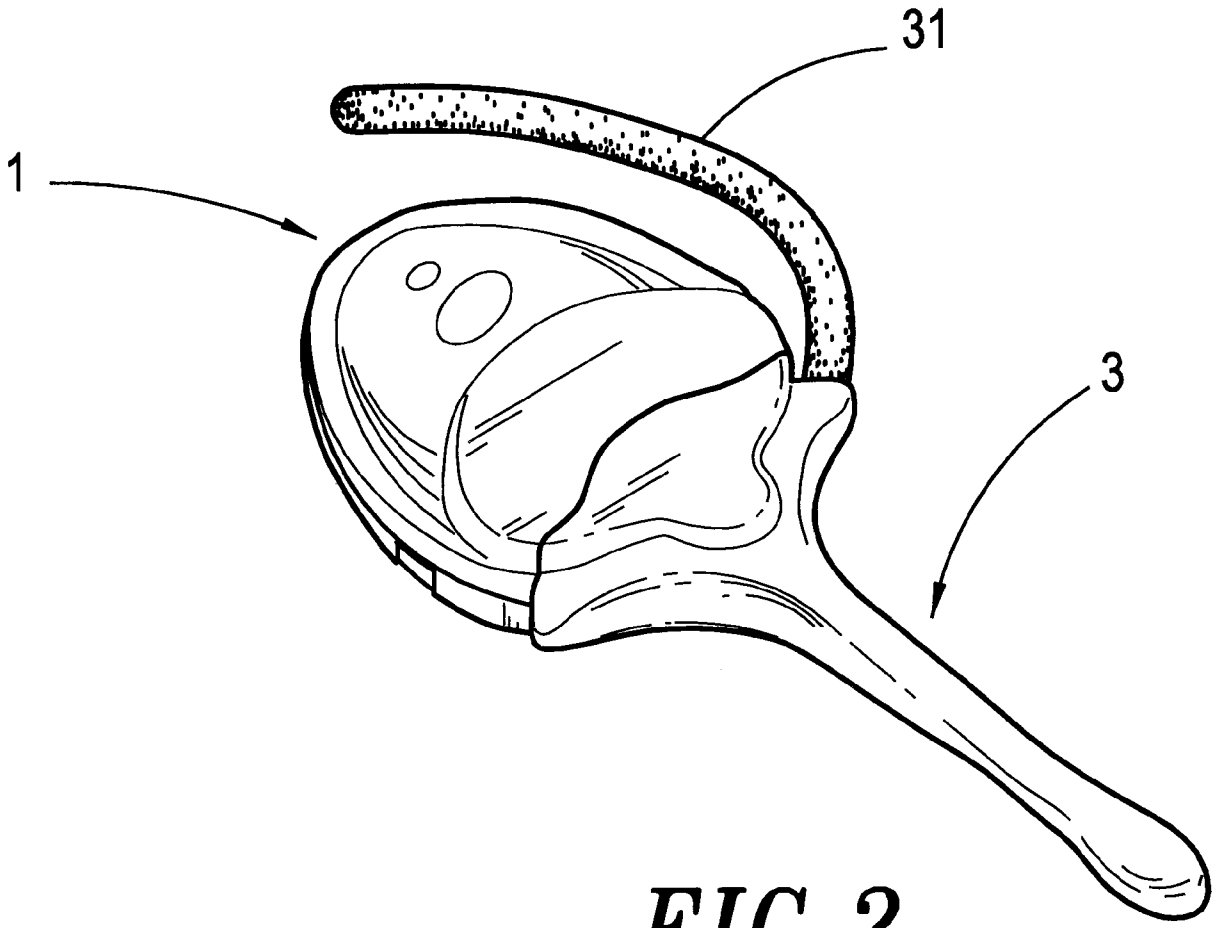
FIG. 2 is an assembled view of the earphone fittable to the right ear according to the present invention.

Referring to FIG. 2, this drawing shows the earphone assembly is fittable to the right ear. The flexible earphone hanger 31 can be hung on the right ear helix from behind, in this version, part of the earphone weight is loaded on the right ear.

Figure 3:
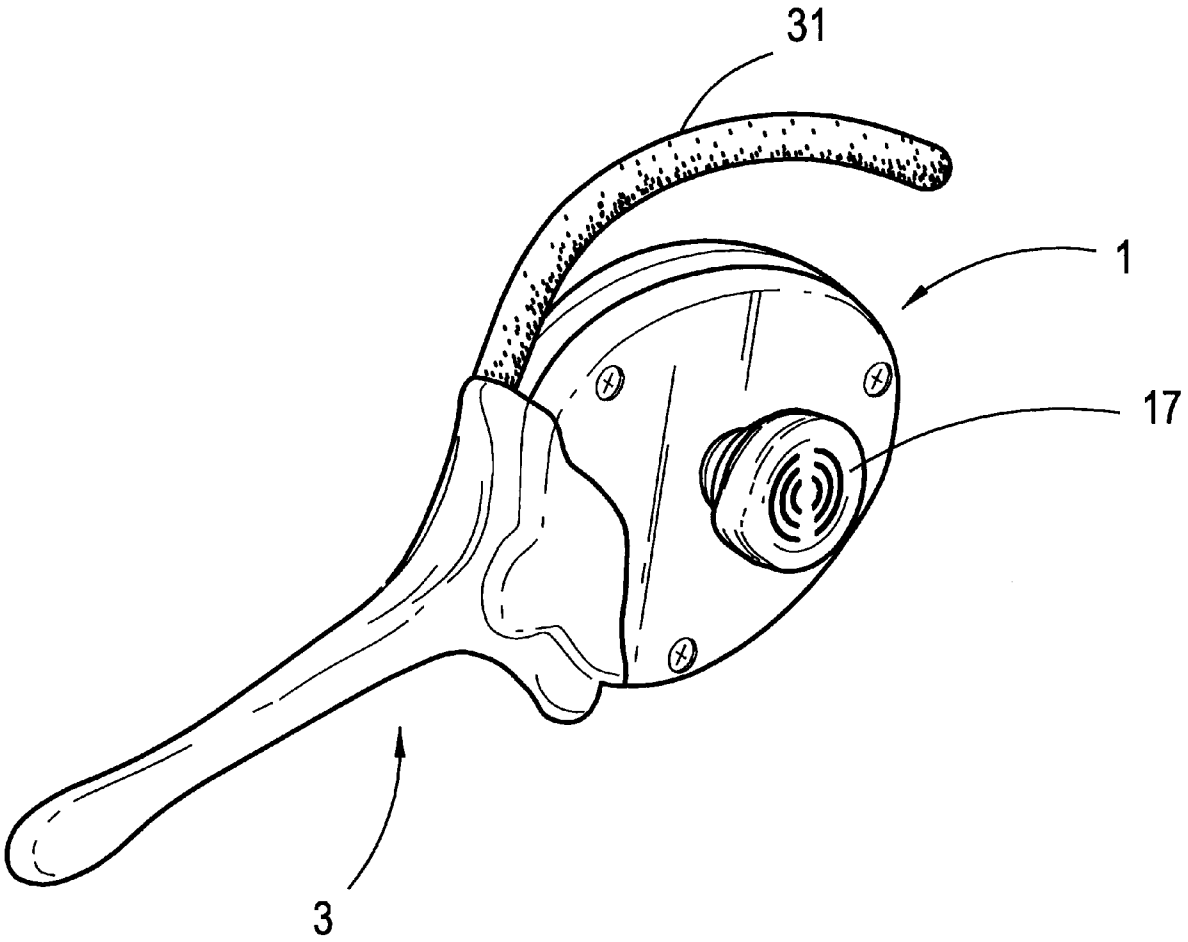
FIG. 3 is an inner view of the earphone fittable to the right ear according to the present invention.

Similar to the case shown in FIG. 2, the earphone of FIG. 3 is also to be hung on the right ear. It is observed that an earphone plug 17 is provided at an appropriate position aligned to the external ear canal.

The function of earphone plug 17 is for collecting stray sound to upgrade the earphone efficiency, and besides, to support the remaining part of the earphone weight on the external ear canal.

Figure 4:
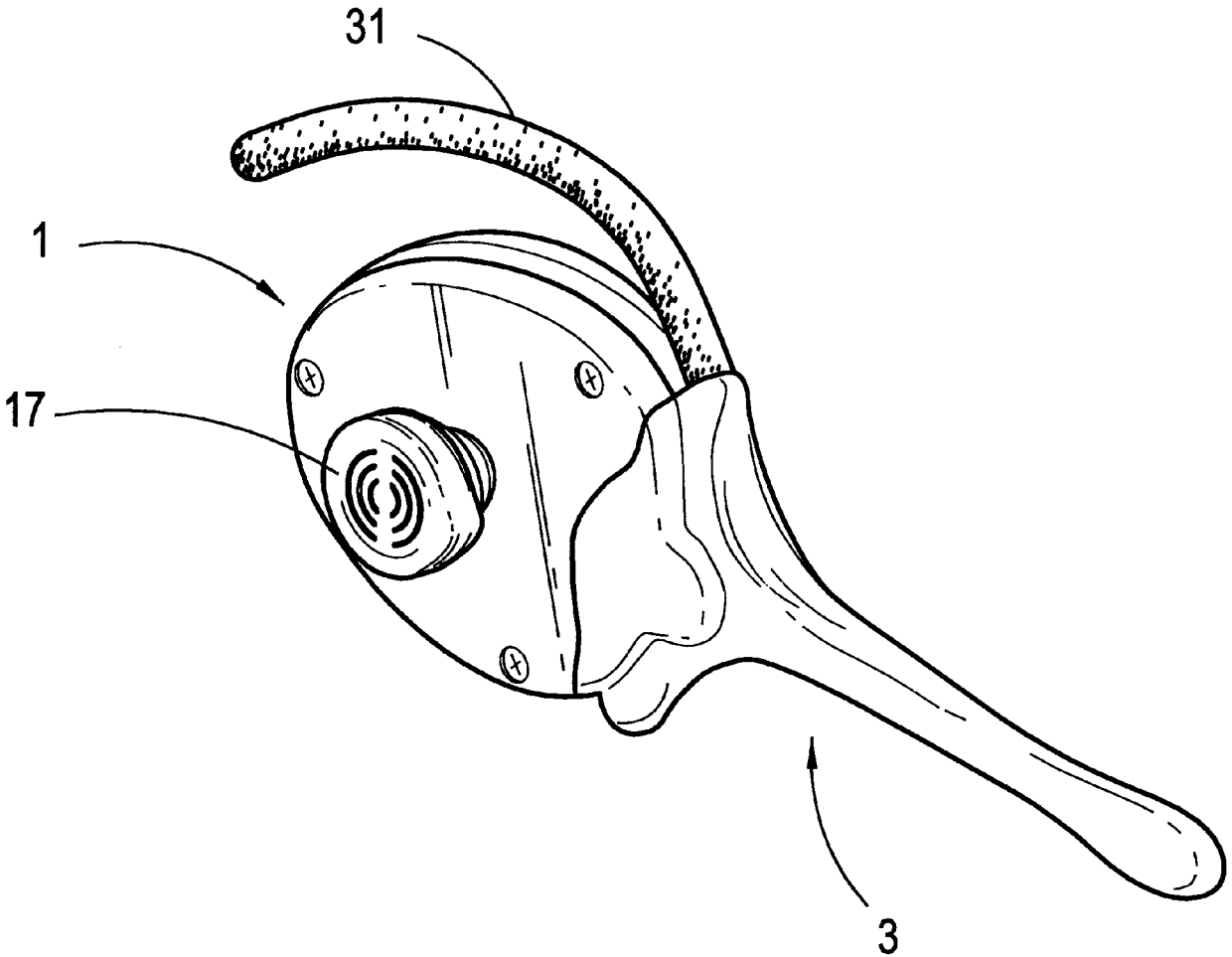
FIG. 4 is an assembled view of the earphone fittable to the left ear according to the present invention.

The earphone shown in FIG. 4 is for hanging on the left ear. As it is described above, when the user wants to hang the earphone from the right ear to the left one, only he/she has to do is just to pull way the bayonet shank 3 to separate the two connection ports 13 and 32, and overturning the bayonet shank 3 about its own longitudinal axis 180°, and then coupling again the two connection ports 13 and 32.

The battery usable for the present invention is a rechargeable lithium battery or a nickel hydrogen battery.

It is understood from the description of the above example that the invention has several noteworthy advantages, in particular:

1. A rechargeable lithium battery or equivalent can be conveniently used for a long time without replacing.
2. It is fitted for both ears so that the syndrome arisen from consistent overwork of single ear can be evaded by alternatively using both ears and also accidental drop down of the earphone can be avoided.
3. Using a two way control switch in future intelligence household appliance to function as a transmission end of voice control is a future trend.

Other embodiments of the present invention will become obvious to those skilled in the art in light of above disclosure. It is of course also understood that the scope of the present invention is not to be determined by the forgoing description, but only by the following claims.

What is claimed is:

1. Earphone fittable to both ears by hanging comprising: essentially a front main body and a rear insertion part;

said front main body further including a housing with a vacancy spacing therein to form a battery compartment for a battery, a projected male connection port, a push button provided on said housing for supplying power from the battery, a pilot lamp, an earphone plug, and an engaging rim formed around the boundary of said housing where said rear insertion part being engaged;

said rear insertion part further including a bayonet shank, a flexible earphone hanger, two tenons, and a recessed female connection port, said two tenons being respectively formed at the upper and the lower portions of said rear insertion part and each equipped with a claw tip so as to grip onto said front main body therewith thereby enclosing said battery in said housing ,of the front body and said rear insertion part;

with this structure, by pulling away said bayonet shank to separate said male and female connection ports, and overturning said bayonet shank about its own longitudinal axis 180°, and then coupling again said two connection ports, said earphone is now fittable for the other ear.

2.The earphone of claim 1, wherein said battery together with said projected male connection port is fixedly coupled with said recessed female connection port.

3.The earphone of claim 1, wherein the weight of said earphone is scattered at two different positions, one on said flexible hanger, and the other, on said earphone plug.

4.The earphone of claim 1, wherein the battery state is detected by the color variation of said pilot lamp.

* * * * *